US006098502A

United States Patent [19]

Pendergrass

[11] Patent Number: 6,098,502

[45] Date of Patent: Aug. 8, 2000

[54] NESTED EXPANSIBLE SOCKET

[75] Inventor: Adrian F. Pendergrass, P.O. Box 28097, San Antonio, Tex. 78238

[73] Assignee: Adrian F. Pendergrass, San Antonio, Tex.

[21] Appl. No.: 09/119,096

[22] Filed: Jul. 20, 1998

[51] Int. Cl.[7] ..... B25B 13/00

[52] U.S. Cl. ..... 81/124.3; 81/124.4

[58] Field of Search ..... 81/121.1, 124.2–124.7, 81/177.2, 177.85

[56] References Cited

U.S. PATENT DOCUMENTS

| | | | |
|---|---|---|---|
| 1,471,451 | 10/1923 | Crimp | 81/124.5 |
| 1,539,136 | 5/1925 | Neel | 81/124.5 |

FOREIGN PATENT DOCUMENTS

| | | | |
|---|---|---|---|
| 2506201 | 11/1982 | France | 81/124.4 |
| 1484717 | 6/1989 | U.S.S.R. | 81/124.5 |
| 999570 | 7/1965 | United Kingdom | 81/124.3 |

*Primary Examiner*—David A. Scherbel
*Assistant Examiner*—David B. Thomas
*Attorney, Agent, or Firm*—Christopher L. Makay

[57] ABSTRACT

A nested expansible socket includes a first socket member and a second socket member coupled to the first socket member whereby the second socket member fits within the first socket member and telescopes relative to the first socket member. The self-adjusting socket further includes a third socket member coupled to the second socket member whereby the third socket member fits within the second socket member and telescopes relative to the first and second socket members.

2 Claims, 2 Drawing Sheets

NESTED EXPANSIBLE SOCKET

BACKGROUND OF THE INVENTION

1. Field of the Invention

The present invention relates to a socket utilized to engage a fastening device, such as a nut, bolt head, or screw head, and, more particularly, but not by way of limitation, to a nested expansible socket suitable for engaging a spark plug obscured by an exhaust manifold.

2. Description of the Related Art

Many exhaust manifolds and in particular headers obscure the upper portion of a spark plug such that an ordinary non-adjustable spark plug socket cannot be fit over the spark plug. Removal and replacement of a spark plug therefore requires the disconnection of the exhaust manifold from the engine head. Upon the disconnection of the exhaust manifold and its movement away from the engine head, the spark plug will be readily accessible to an ordinary non-adjustable spark plug socket. After the removal and the replacement of the spark plug, the exhaust manifold is reconnected to the engine head thereby completing the task of changing the spark plug.

It is highly undesirable to disconnect an exhaust manifold in order to remove and replace a spark plug. That additional task significantly increases the amount of time required to remove and replace a spark plug as well as the cost. For example, disconnecting the exhaust manifold often requires the replacement of the exhaust manifold gaskets to prevent exhaust leaks. In addition, the disconnected exhaust manifold is supported by the remaining portion of the exhaust system, which weakens the exhaust system, thereby increasing the likelihood of damage to the exhaust system. Accordingly, a socket useable to remove a spark plug without first disconnecting an exhaust manifold would significantly improve over a socket requiring such a disconnection.

SUMMARY OF THE INVENTION

In accordance with the present invention, a nested expansible socket includes a first socket member and a second socket member coupled to the first socket member whereby the second socket member fits within the first socket member and telescopes relative to the first socket member. The second socket member includes a groove therein, and the first socket member includes a pin that engages the groove of the second socket member to secure the second socket member within the first socket member and to permit the second socket member to telescope relative to the first socket member.

When the nested expansible socket is placed over a spark plug or fastening device, such as a nut, bolt head, or screw head, the second socket member contacts the spark plug or fastening device and telescopes relative to the first socket member. The interior surface of the first socket member provides an engaging surface for the spark plug or fastening device, while the exterior surface of the second socket member provides an engaging surface for a tool. The interior of the second socket member includes a passageway that permits the end of the spark plug or fastening device to pass therethrough.

The nested expansible socket further includes a third socket member coupled to the second socket member whereby the third socket member fits within the second socket member and telescopes relative to the first and second socket members. The third socket member includes a groove therein, and the second socket member includes a pin that engages the groove of the third socket member to secure the third socket member within the second socket member and to permit the third socket member to telescope relative to the first and second socket members.

When the nested expansible socket is placed over a spark plug or fastening device, such as a nut, bolt head, or screw head, the third socket member contacts the spark plug or fastening device and telescopes relative to the first and second socket members. The interior surface of the third socket member provides an engaging surface for the spark plug or fastening device, while the exterior surface of the third socket member provides an engaging surface for a tool. The interior of the third socket member includes a passageway that permits the end of the spark plug or fastening device to pass therethrough.

A method of engaging a spark plug or fastening device with the nested expansible socket to permit the tightening or loosening of the spark plug or fastening device includes positioning the nested expansible socket over the spark plug or fastening device, releasing the nested expansible socket whereby the second socket member contacts the spark plug or fastening device so that the first socket member telescopes relative to the second socket member, engaging the spark plug or fastening device with the first socket member, and engaging the second socket member with a tool thereby permitting the tightening or loosening of the spark plug or fastening device. The method of engaging a spark plug or fastening device with the nested expansible socket to permit the tightening or loosening of the spark plug or fastening device further includes positioning the nested expansible socket over the spark plug or fastening device, releasing the nested expansible socket whereby the third socket member contacts the spark plug or fastening device so that to the first and second socket members telescope relative to the third socket member, engaging the spark plug or fastening device with the second socket member, and engaging the third socket member with a tool thereby permitting the tightening or loosening of the spark plug or fastening device.

It is therefore an object of the present invention to provide a socket that engages an obscured spark plug or fastening device, such as a nut, bolt head, or screw head.

It is a further object of the present invention to provide a socket that permits tightening and loosening of spark plugs without first disconnecting an exhaust manifold.

Still other obvious objects, features, and advantages of the present invention will become evident to those of ordinary skill in art of the following.

DETAILED DESCRIPTION OF THE PREFERRED EMBODIMENT

Figure 1:
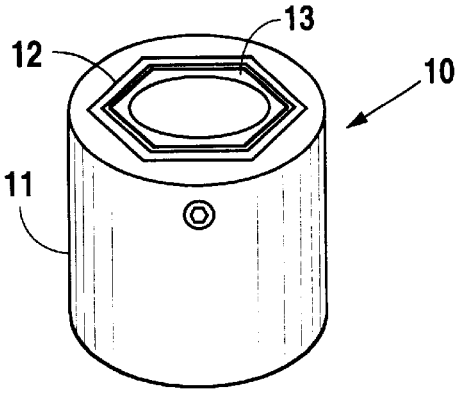
FIG. 1 is a perspective view illustrating a nested expansible socket in a closed position.
Figure 2:
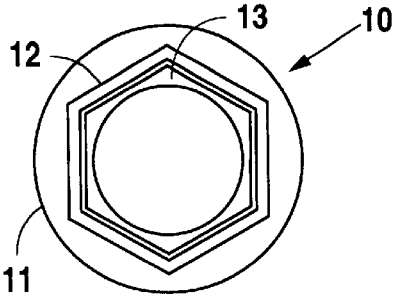
FIG. 2 is a top plan view illustrating the nested expansible socket in the closed position.

A nested expansible socket 10 includes a first or outer socket member 11, a second or intermediate socket member 12, and a third or inner socket member 13. The socket member 11 in this preferred embodiment is cylindrical in shape and includes a hexagonally shaped interior portion that defines a six-point engaging surface for a spark plug or a fastening device, such as a nut, bolt head, or screw head.

The socket member 12 in this preferred embodiment is hexagonally shaped on both its interior and its exterior and is sized to fit within the hexagonally shaped interior portion of the socket member 11. The hexagonally shaped interior portion of the socket member 12 defines a six-point engaging surface for a spark plug or a fastening device, such as a nut, bolt head, or screw head. The socket member 12 includes a groove 14, while the socket member 11 includes an aperture 15 having a pin 16 press fit therein. The pin 16 extends through the aperture 15 and engages the groove 14 to secure the socket member 12 to the socket member 11. The engagement of the groove 14 by the pin 16 not only secures the socket member 12 to the socket member 11 but also permits the socket member 12 to telescope relative to the socket member 11.

The socket member 13 includes a hexagonally shaped exterior and a cylindrically shaped interior. The cylindrically shaped interior permits an end of a spark plug to pass through the socket 10. The exterior of the socket member 13 is hexagonally shaped and sized so that the socket member 13 fits within the socket member 12. The socket member 13 includes a groove 17, while the socket member 12 includes an aperture 18 and a pin 19 press fit therein. The pin 19 extends through the aperture 18 and engages the groove 17 to secure the socket member 13 to the socket number 12. The engagement of the groove 17 by the pin 19 not only secures the socket member 13 to the socket member 12 but also permits the socket member 13 to telescope relative to the socket member 12.

Figure 3:
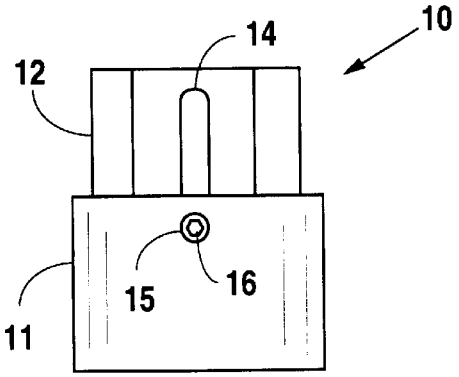
FIG. 3 is a side elevation view illustrating the nested expansible socket in a first open position.
Figure 4:
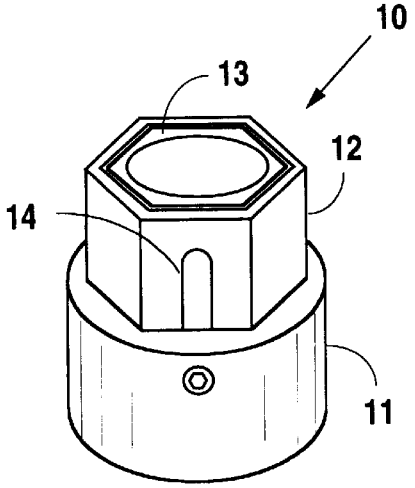
FIG. 4 is a perspective view illustrating the nested expansible socket in the first open position.

In use the socket 10 is positioned over a spark plug such that the end of the spark plug will pass through the interior of the socket member 13 as the socket 10 drops over the spark plug. For a larger sized spark plug, the nut portion of the spark plug engages the bottom surface of the socket member 12 as the socket 10 drops over the spark plug, thereby driving the socket member 12 to the first open position illustrated in FIGS. 3 and 4. In the first open position, the six point engaging surface defined by the hexagonal interior of the socket member 11 engages the nut portion of the spark plug, while the socket member 12 provides an engaging surface for a tool, such as wrench or a socket wrench, which is utilized to loosen and remove the spark plug.

Figure 5:
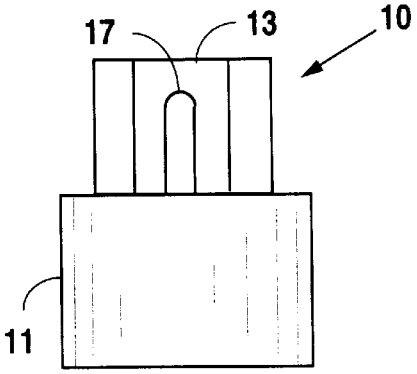
FIG. 5 is a side elevation view illustrating the nested expansible socket in a second open position.
Figure 6:
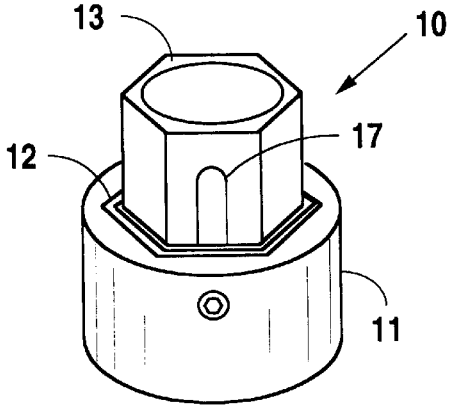
FIG. 6 is perspective view illustrating the nested expansible socket in the second open position.

For a smaller sized spark plug, the nut portion of the spark plug engages the bottom surface of the socket member 13 as the socket 10 drops over the spark plug; thereby driving the socket member 13 to the second open position illustrated in FIGS. 5 and 6. In the second open position, the six point engaging surface defined by the hexagonal interior of the socket member 12 engages the nut portion of the spark plug, while the socket member 13 provides an engaging surface for a tool, such as wrench or a socket wrench, which is utilized to loosen and remove the spark plug.

Figure 7:
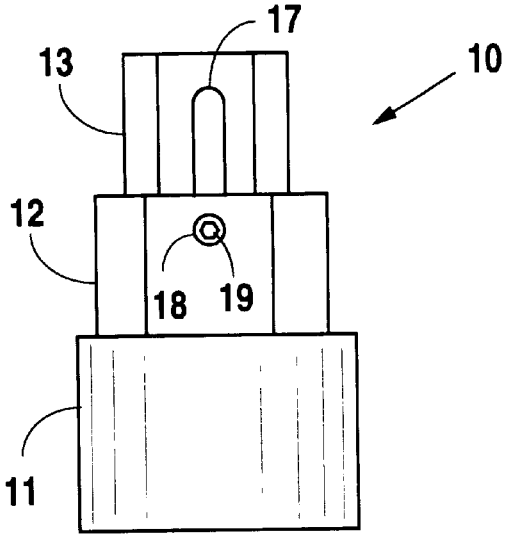
FIG. 7 is a side elevation view illustrating the nested expansible socket in a fully extended position.
Figure 8:
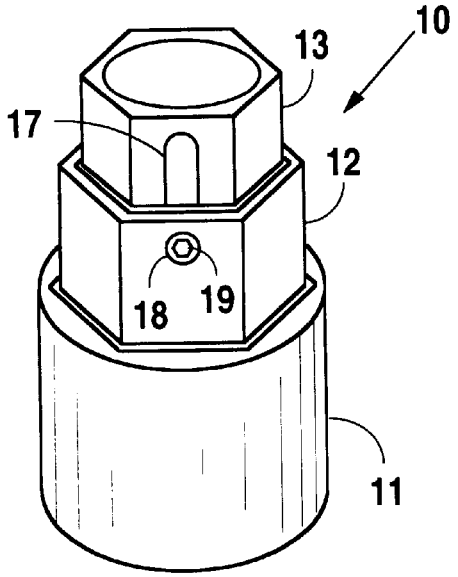
FIG. 8 is perspective view illustrating the nested expansible socket in the fully extended position.

Although the nested expansible socket 10 has been disclosed as including socket members 11–13, one of ordinary skill in the art will recognize that only two socket members are actually required. Illustratively for a larger sized spark plug or fastening device, the nested expansible socket 10 would include only the socket members 11 and 12 as previously described. For a smaller size spark plug or fastening device, the nested expansible socket 10 would include only the socket members 12 and 13 as previously described, except that the socket member 12 would include a cylindrical shape similar to that of the socket member 11. One of ordinary skill in the art will also recognize that additional socket members may be included. Furthermore, one of ordinary skill in the art should understand that FIGS. 7 and 8 are provided to illustrate the relationship among the socket members 11–13 and does not necessarily show a position of the socket members 11–13 during actual use.

Figure 9:
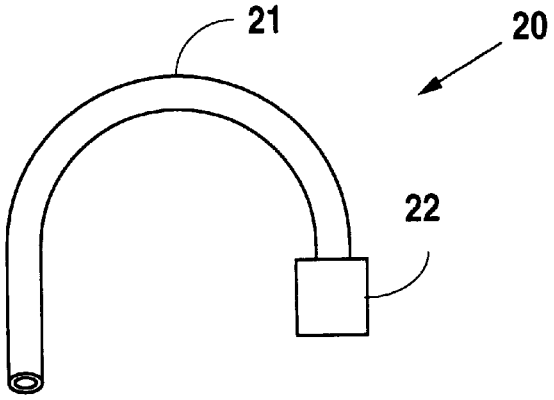
FIG. 9 is a perspective view illustrating an apparatus for placing a spark plug in a spark plug seat of an engine head.

FIG. 9 illustrates apparatus 20 for placing a spark plug in a spark plug seat of an engine head. The apparatus 20 includes a tube 21 and a head 22. The head 22 includes a protrusion (not shown) that fits into the tube 21 to form a connection therebetween. In use an upper end of a spark plug is inserted into the tube 21 until the tube 21 is capable of solely supporting the spark plug. The apparatus 20 is then utilized to guide the spark plug into the spark plug seat of an engine head. Once the spark plug has been positioned at the spark plug seat, the apparatus 20 is put into the approximate position illustrated in FIG. 9 so that, upon the rotation of the head 22, the tube 21 rotates thereby threading the spark plug into the spark plug seat. After the spark plug has been sufficiently threaded, the apparatus 20 is removed, and the socket 10 is employed to permit the appropriate tightening of the spark plug. The socket 10 operates as previously described, except it is operated in a direction that tightens the spark plug.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather it is defined by the claims that follow.

I claim:

1. A method of engaging a spark plug or fastening device with a nested expansible socket to permit the tightening or loosening of the spark plug or fastening device, comprising the steps of: providing a nested expansible socket, comprising;

a first socket member including an interior surface that provides an engaging surface for a spark plug or fastening device, and a second socket member that fits within the first socket member and telescopes relative to the first socket member to expose an exterior surface of the second socket member, thereby providing an engaging surface for a tool, whereby the second socket member is coupled to the first socket member such tat the second socket member transfers rotational motion to the first socket member to facilitate the tightening or loosening of a spark plug or fastening device;

positioning the nested expansible socket over the spark plug or fastening device;

releasing the nested expansible socket whereby the second socket member contacts the spark plug or fastening device that the first socket member telescopes relative to the second socket member;

engaging the spark plug or fastening device with the first socket member; and engaging the second socket member with a tool thereby permitting the tightening or loosening of the spark plug or fastening device.

2. The method of engaging a spark plug or fastening device with a nested expansible socket to permit the tightening or loosening of the spark plug or fastening device according to claim 1, further comprising:

the step of providing a nested expansible socket further comprising providing a third socket member that fits within the second socket member and telescopes relative to the second socket member to expose an exterior surface of the third socket member, thereby providing an engaging surface for a tool, whereby the third socket member is coupled to the second socket member such that the third socket member transfers rotational motion to the second socket member to facilitate the tightening or loosening of a spark plug or fastening device;

said step of releasing the nested expansible socket further including the third socket member contacting the spark plug or fastening device so that the first and second socket members telescope relative to the third socket member; and engaging the third socket member with a tool thereby permitting the tightening or loosening of the spark plug or fastening device.

* * * * *